US005198800A

United States Patent [19]

Tozawa et al.

[11] Patent Number: 5,198,800

[45] Date of Patent: Mar. 30, 1993

[54] ALARM SYSTEM FOR CONSTRUCTIONAL MACHINE

[75] Inventors: Shoji Tozawa, Kobe; Saburo Tanaka, Ohno; Makoto Iga, Kakogawa, all of Japan

[73] Assignee: Shin Caterpillar Mitsubishi Ltd., Tokyo, Japan

[21] Appl. No.: 716,526

[22] Filed: Jun. 17, 1991

[30] Foreign Application Priority Data

Jun. 21, 1990 [JP] Japan ..... 2-163064

[51] Int. Cl.[5] ..... G08B 23/00; B66C 13/16; H04B 1/40

[52] U.S. Cl. ..... 340/573; 212/153; 340/685; 364/424.07; 455/88

[58] Field of Search ..... 340/573, 685-686, 340/552-557, 463, 436, 903, 691; 367/93-94; 342/27; 455/88-90, 100, 53-54; 212/153-154; 364/424.07; 200/61.44; 901/11-13, 46, 49-50

[56] References Cited

U.S. PATENT DOCUMENTS

| | | | |
|---|---|---|---|
| 4,128,827 | 12/1978 | Coleman et al. | 340/463 |
| 4,434,901 | 3/1984 | Gehl | 212/153 |
| 4,937,795 | 6/1990 | Motegi et al. | 367/93 |
| 5,047,752 | 9/1991 | Schorn | 367/93 X |

FOREIGN PATENT DOCUMENTS

| | | | |
|---|---|---|---|
| 3501598 | 7/1986 | Fed. Rep. of Germany | 340/556 |
| 0867856 | 9/1981 | U.S.S.R. | 212/153 |

*Primary Examiner*—Jin F. Ng
*Assistant Examiner*—Thomas J. Mullen, Jr.
*Attorney, Agent, or Firm*—Willian Brinks Olds Hofer Gilson & Lione

[57] ABSTRACT

An excavator includes an upper structure swingably supported by a lower structure. A worker position sensor consists of a plurality of radio frequency transceivers provided in the excavator and a radio frequency transceiver carried by each of the excavation workers working within the working range of the excavator. A signal processing unit determines whether the relative distance between each worker and the excavator is either of short distance, slightly long distance or long distance and identifies the position of each worker for each of the predetermined identifying areas. A determining signal from the signal processing unit is supplied to a control unit. The control unit is connected to a drive unit which includes electro-hydraulic proportional valves for energizing actuators for positioning, swing, and traveling of the excavator. This control unit is also connected to a machine sensor which includes a swing angle sensor, a traveling level sensor, and a swing operation lever sensor. The control unit determines whether the machine is moved to approach the workers. The control unit controls the machine so that the lower structure stops or travels slowly or the upper structure swings slowly when the machine is approaching the workers and, so that the movement of the machine remains unchanged when it is moved away from the workers.

9 Claims, 3 Drawing Sheets

ALARM SYSTEM FOR CONSTRUCTIONAL MACHINE

BACKGROUND OF THE INVENTION

1. Field of the Invention

The present invention relates to an alarm system for a constructional machine comprising an upper structure swingably supported by a lower structure which can travel, for example, move forward, reverse and turn, and in particular, to an alarm system for an excavator ensuring that the excavator protects excavation workers working in the excavation job site where the excavator is operated.

2. Description of the Prior Art

Due to limited operator visibility toward the rear of many vehicles, audible back-up alarms are often provided to warn personnel in the area that the vehicle is moving backward. However, some vehicles, such as hydraulic excavators, have an upper structure that can swing 360° so that the position of the upper structure with respect to the lower structure may be in any orientation, such that the operator's visibility toward the direction of vehicle motion may be limited or obscured. Thus, on those vehicles, it is desirable to have an audible alarm when the vehicle starts to move in either direction. It is also desirable that such an audible alarm be activated automatically immediately upon the vehicle being put in condition for movement in either direction, such as when the vehicle brakes are released or the vehicle power train is shifted from the neutral position. Since the area immediately adjacent the vehicle is the primary concern, if the vehicle is traveling in the forward direction with respect to the upper structure, it is desirable to provide a means of manually de-activating the alarm. However, once the vehicle is stopped, the alarm controls should be constructed such that they will automatically restore to their ready condition, so that the alarm will again be automatically activated without any attention from its operator when the vehicle is conditioned for travel.

The invention of U.S. Pat. No. 4,128,827 is directed to overcoming one or more of the problems as set forth above. In an alarm system disclosed in the U.S. Patent, a switch connected to a power source is closed automatically in response to a vehicle being conditioned for travel and is opened in response to the vehicle being stopped. First and second apparatuses deliver first and second electrical signals, respectively, to a switching device in response to the switch being closed. The switching device is rendered conductive for connecting the power source to an alarm for energizing the alarm when either one or both of the first and second signals is delivered thereto. The switching device is rendered conductive for connecting the power source to an alarm for energizing the alarm when either one or both of the first and second signals is delivered thereto. The switching device is rendered nonconductive for deenergizing the alarm in response to neither of the signals being present. A timer stops delivery of the first signal to the switching device only after the first signal has been delivered to the switching device for a predetermined period of time. A manual override is provided for manually selectively stopping delivery of the second signal to the switching device.

In such an alarm system, the operator of the excavator has to continuously monitor a relative distance between each of the excavator workers and the excavator by his eyes or using a position sensor for sensing the positions of the excavator workers. One of such position sensors includes transceivers provided at the excavator and a worker's transceiver carried by each excavator, worker. When any worker enters the working range of the excavator, the alarm system advises both the worker and the operator of the excavator through an alarm and a warning lamp. Simultaneously, the alarm system stops the whole movement of the excavator, that is, the swing movement of the upper structure and the travelling movement of the lower structure.

When the excavator is used in narrow job site, workers approach the excavator very frequently. Consequently, the operation of the excavator is often stopped, and as a result, a working efficiency is decreased.

Thus, it is desired to provide an improved alarm system which enables the excavator to protect the excavator workers without decreasing working efficiency.

SUMMARY OF THE INVENTION

FIG. 1 is a view illustrating the whole construction of the present invention. As shown in FIG. 1, the present invention provides an alarm system for a constructional machine including an upper structure which is swingably supported by a lower structure, the alarm system comprising: a worker position sensor 110 for sensing the positions of workers which are working within the working range of the machine; distance determining means 112 in response to the signal from the worker position sensor for determining the relative distance between each of the workers and the machine; worker sensing area determining means 114 in response to the signal from the distance determining means for identifying the positions of the workers in the predetermined identifying areas; a machine sensor 116 which comprises a swing angle sensor 118 for sensing the swing angle of the upper structure, a traveling direction sensor 120 for sensing the traveling direction of the lower structure, and a swing direction sensor 122 for sensing the swing direction of the upper structure; machine operation determining means 124 in response to the signal from the machine sensor for determining the swing angle, the traveling direction and the swing direction of the machine; machine operation selecting means 126 in response to the signal from the machine operation determining means and the signal from the worker sensing area determining means for selecting to stop the machine, to operate the machine; at a slower rate or to maintain the present rate of operation of the machine unchanged; and a drive unit 128 in response to the signal from the machine operation selecting means for driving the machine.

The worker position sensor according to the present invention may comprise a plurality of radio frequency transceivers or ultrasonic transceiver provided in the machine and a radio frequency transceiver or ultrasonic transceiver carried by each of workers working within the working range of the machine. In a signal processing unit, distance determining means determines whether the relative distance between each worker and the machine is either of short distance, slightly long distance or long distance. Then, the sensing area determining means identifies the positions of the workers in the predetermined areas. This signal processing unit can change the number and the range of the identifying areas in correspondence to the number of the machine transceivers. For example, three transceivers each of which has a sensing angle of 180 degree (the transceivers are capable of measuring distance ) may be used to provide substantially six identifying areas from a combination of areas overlappingly covered by the transceivers and the other areas.

The determining signal from the signal processing unit is supplied to a control unit. This control unit is connected to a drive unit which includes a solenoid valve and electro-hydraulic proportional valves for driving actuators for positioning, swing and traveling of the machine. This control unit is also connected to a machine sensor which includes a swing angle sensor, a traveling lever sensor and a swing operation lever sensor. The control unit determines whether the machine is moved to approach the workers from the area where the workers are working, and the directions in which the lower structure is going to travel or the upper structure is going to swing. Then, the control unit controls the movement of the machine so that the lower structure stops or travels slowly, or the upper structure swings slowly when it is determined that the machine is moved to approach the workers, or the movement of the machine remains unchanged when it is determined that the machine moves away from the workers.

For example, all of the drive units are stopped when workers are working right near the upper structure. In the other cases, the following controls are performed:

With respect to the swing movement, the upper structure is controlled in response to the signal from the swing operation lever sensor which includes right and left swing operation lever sensors. In the case that the right swing operation lever sensor is turned on, that is, the operator is going to swing the upper structure from forward to rightward, the machine is controlled to stop the movement of the upper structure when the workers are working at the right forward of the machine and to move slowly when the workers are working just at the rightward or at the right backward of the machine.

When the above-mentioned circumstances are changed by further swing movement of the upper structure or further movements of the workers, the content of control to the machine is changed in correspondence to the changed circumstances. For example, the machine is controlled to immediately stop the movement of the upper structure when the upper structure has swung rightward, resulting that the position of the upper structure relative to the workers is shifted from the just rightward to the right forward. In the case that the upper structure swings leftward, the machine is controlled inversely.

With respect to the traveling movement, the relation between the direction of the lower structure and the positions of the workers are checked from the signals supplied by the traveling lever sensor and the swing angle sensor. If it is determined that any worker is working in the traveling direction of the lower structure, the machine is controlled to stop the movement of the lower structure.

In the case where the machine is turned by using a traveling control lever (in the case that only one of the right traveling control lever and the left traveling control lever is operated while the other control lever is not operated or both of the control levers are operated inversely to each other), a logical sum between the control signal for traveling movement and the control signal for swing movement is calculated.

For example, if the traveling control levers are operated rightward (rightward turning) or forward, the machine is controlled so that both the movement of the lower structure and the movement of the upper structure is stopped immediately when any worker is working at the forward or right forward of the lower structure, and the upper structure swings slowly and the lower structure travels slowly when any worker is working just at the rightward or at the right backward of the upper structure.

The transceiver carried by each worker may be provided with a warning alarm advising the worker that the machine is approaching. A warning alarm and a warning lamp may be provided in the machine for indicating the position of the workers and the relative distance between the workers and the machine. Particularly, the warning lamp allows the operator to learn which direction the upper structure is positioned relative to the lower structure.

The position of the workers and the direction of the upper structure are indicated by the warning lamp in real time and advise the operator by an alarm sound. The alarm sound varies depending on the positions of the workers, the traveling direction of the lower structure, and the swing direction of the upper structure. For example, if any worker is working right near the machine, in the traveling direction of the machine or in the swing direction of the machine, the alarm sounds intermittently in a short time interval. If no worker is working within the working range of the machine, the alarm does not sound. The alarm sounds at both sides of the transceivers provided in the machine and the transceiver carried by each worker. That is, the alarm sounds intermittently in a short time interval when the distance between the worker and the machine is short, the alarm sounds intermittently in a long time interval when the distance is relatively long, and the alarm does not sound when the distance is very long.

BRIEF DESCRIPTION OF THE DRAWING FIGURES

DETAILED DESCRIPTION OF THE PREFERRED EMBODIMENT

Figure 1:
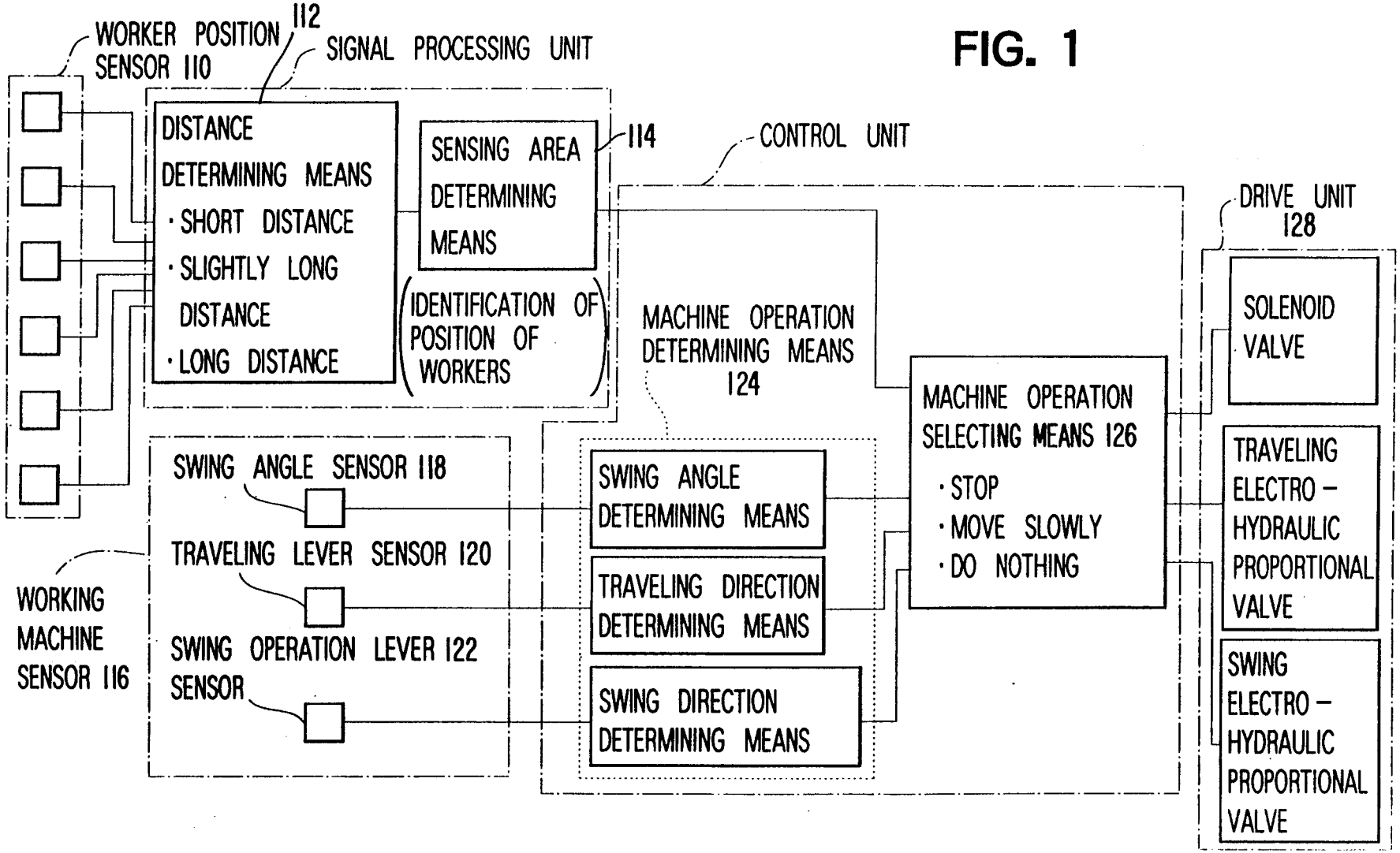
FIG. 1 is a block view showing the whole construction of the present invention.
Figure 2:
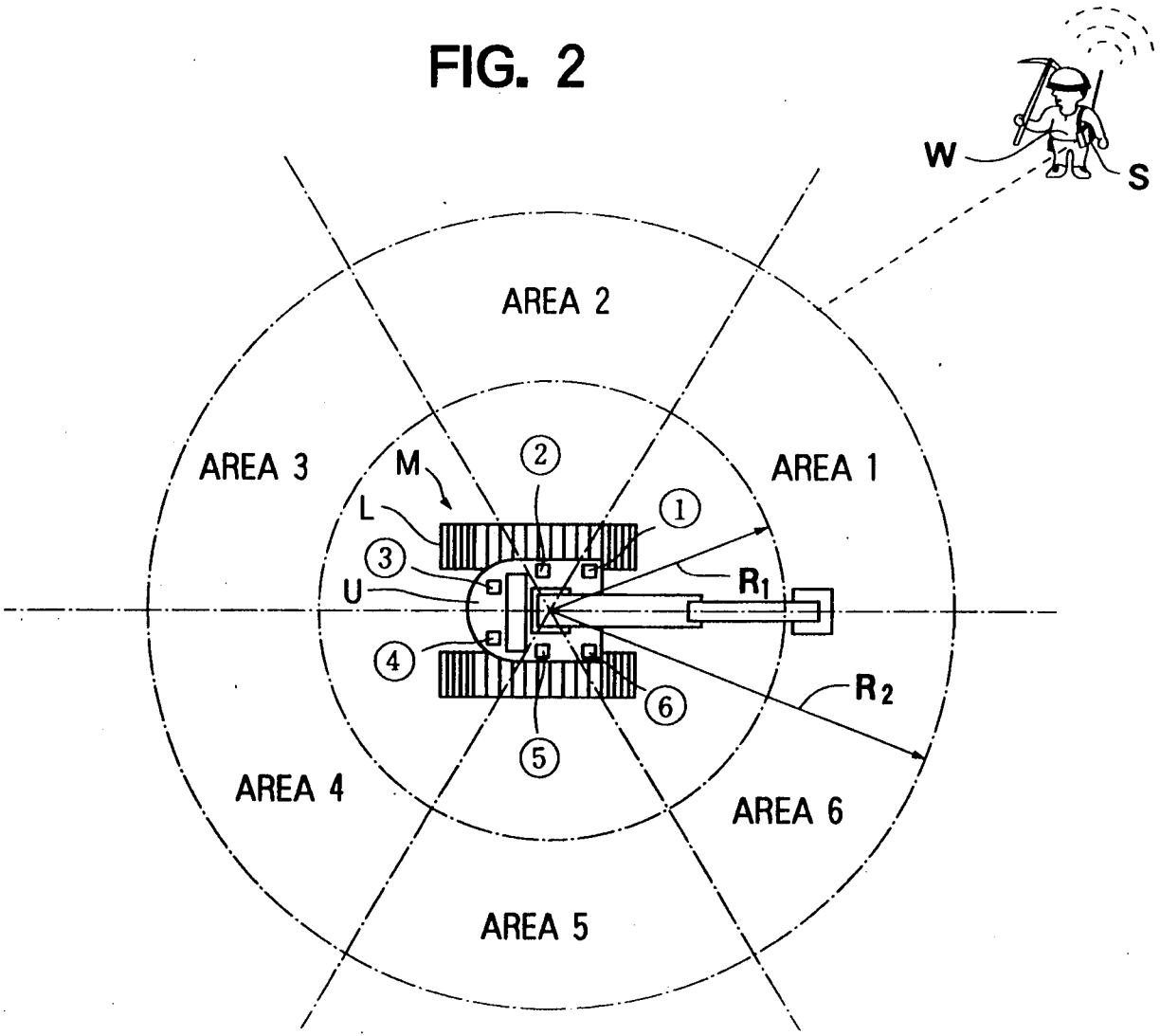
FIG. 2 is a plan view showing an hydraulic excavator with a alarm system according to the present invention.
Figure 3:
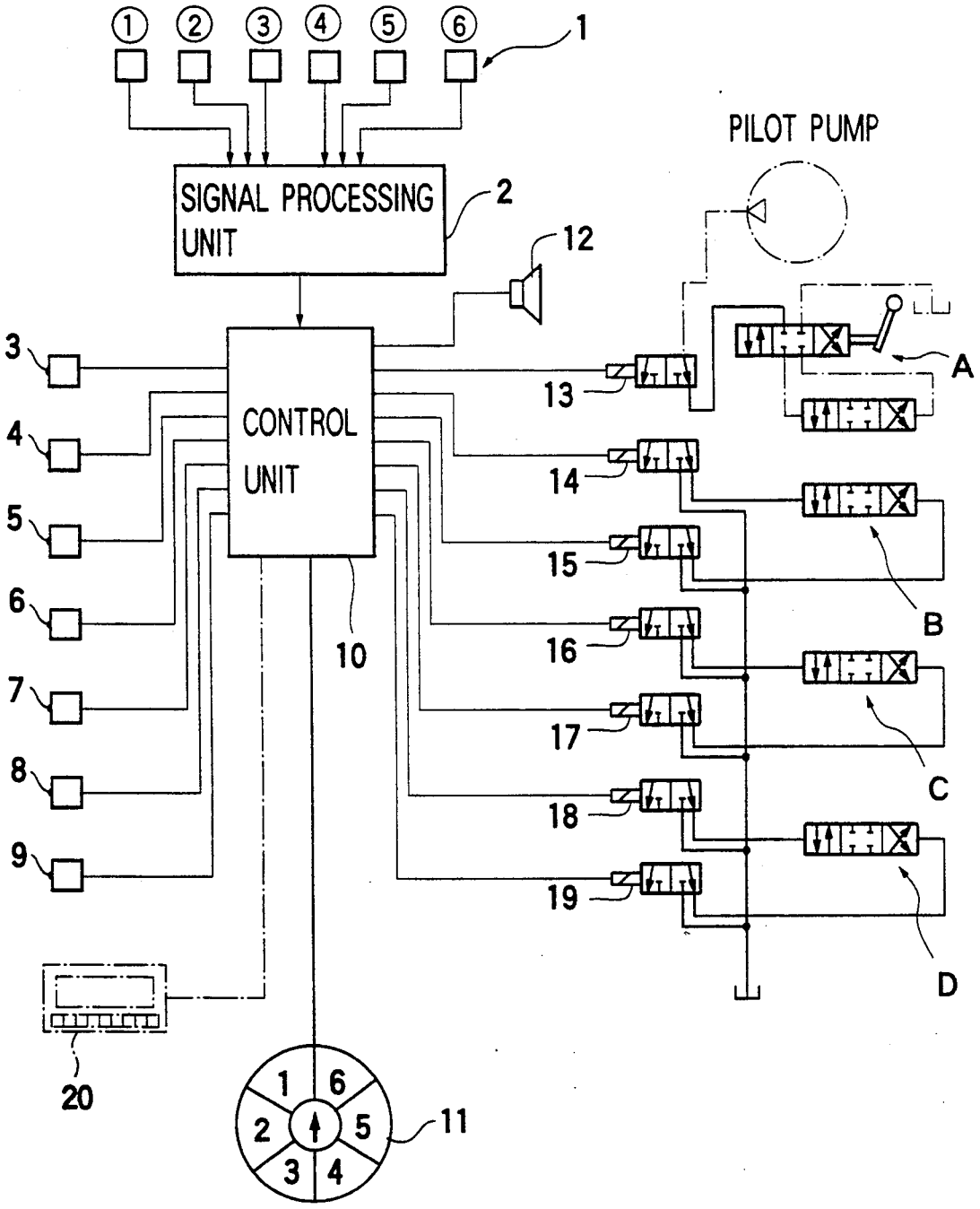
FIG. 3 is a general view showing the construction of the alarm system of FIG. 2.

FIG. 2 shows a plan view of a hydraulic excavator with an alarm system according to the present invention. FIG. 3 shows an embodiment of the alarm system. In FIG. 2, an area adjacent to the lower structure of the excavator and AREA 1~AREA 6, which totals 7 areas, are identifying areas of the alarm system. The inside of a circle of radius R: in which these identifying areas are included is the sensed range which the alarm system covers.

As shown in FIG. 2, the hydraulic excavator M includes an upper structure U, i.e. a swing frame which is swingably supported by a lower structure L. The upper structure U has a bucket movably supported at the leading end of an arm. The lower structure L has a car body and an undercarriage including sprockets and traveling chains. A worker position sensor 1 includes six transceivers ①-⑥ provided in the excavator M and a transceiver S carried by each of the excavation workers W. However, the number of the identifying areas may be increased by increasing the number of the excavator transceivers. A size of the sense range as shown in FIG. 2, that is, sizes of the circles of radii $R_1$ and $R_2$ can be modified in correspondence to a size of the lower structure of the hydraulic excavator and a size of the excavation job site by using an external regulation terminal 20 as shown in FIG. 3, which is described hereafter.

The worker's ultrasonic transceiver S is provided with an alarm advising the worker that he is working within the working range of the excavator. The worker's ultrasonic transceiver S includes an ultrasonic transmitter which is adapted to transmit a different frequency from that of ultrasonic transceivers ①-⑥ of the excavator and an ultrasonic receiver which is adapted to receive the same frequency as that of the ultrasonic transceivers ①-⑥ whereby both the worker and the excavator can obtain information concerning the distance therebetween. The ultrasonic transceivers ①-⑥ can transmit and receive an ultrasonic wave only within the limited range (a range defined by a fan of angle 60° in FIG. 2 ) and identify the position of the worker relative to the excavator from the signals received by the ultrasonic transceivers ①-⑥.

Three transceivers each of which is sensitive in the range of a fan of 180° may be used in place of the six transceivers by overlapping the sense area to substantially provide six identifying areas. A manpack radios or VHF radios may be used in place of the ultrasonic transceivers. The other type of position sensor may also be used.

In FIG. 3, the six ultrasonic transceivers ①-⑥ of the sensor 1 are connected to a signal processing structure 2. In the signal processing structure 2, a decision is made on the distance between the worker and the excavator, and a decision is made on the area where the worker is working. A decision signal from the signal processing structure 2 is transmitted to a control unit 10 by serial or parallel communications.

The excavator is provided with right and left working control levers and right and left traveling control levers (not shown in figures). The upper structure of the excavator can swing rightward and leftward by the operator operating one of the working control levers. The other working operation such as digging or excavation is performed by the operator operating the other working control lever. The lower structure of the excavator can travel in any direction by the operator operating the right traveling control lever and the left traveling control lever respectively. The lower structure can move forward and reverse by the operator operating the right and left traveling control levers forwardly and backwardly The lower structure can turn by the operator operating only one of the traveling control levers or operating both of the traveling control levers in the opposite direction to each other.

The swing operation of the upper structure are sensed by a swing operation lever sensor which includes a left swing operation lever sensor 3 and a right swing operation lever sensor 4. Similarly, the traveling movement of the lower structure is sensed by a traveling lever sensor which includes a right forward traveling lever sensor 5, a right backward traveling lever sensor 6, a left forward traveling lever sensor 7 and a left backward traveling lever sensor 8. The sensors 3, 4, 5, 6, 7 and 8 may be hydraulic switches. The swing angle of the upper structure is sensed by a swing angle sensor 9.

The swing operation lever sensors 3 and 4 which are incorporated into a pilot hydraulic line (not shown in figures), the traveling lever sensors 5, 6, 7 and 8, and the swing angle sensor 9 are connected to the control unit 10, so that the sensors can sense the swing angle, the swing direction and the traveling direction operated by the operator. In response to a signal from each sensor and a decision signal from the signal processing unit 2, the control unit 10 is adapted to supply drive signals to a solenoid valve 13 for driving a working operation control valve A, left swing and right swing electro-hydraulic proportional valves 14 and 15 for driving a swing control valve B, right forward traveling and right backward traveling electro-hydraulic proportional valves 16 and 17 for driving a right traveling control valve C, and left forward traveling and left backward traveling electro-hydraulic proportional valves 18 and 19 for driving a left traveling control valve D, as well as to supply an indicating signal to a warning lamp 11.

The drive signals to the solenoid valve 13 and the electro-hydraulic proportional valves 14, 15, 16, 17, 18 and 19 varies depending on the extent that the excavator is approaching the workers as mentioned above. For example, if any worker is working within the circle of radius $R_1$, all of the valves 13-19 are turned on and the upper structure and the lower structure completely stop. If any worker is working in the AREA 1 or AREA 2, the solenoid valve 13 is turned on to stop the working operation. In the case that any worker is working in AREA 6, the right swing electro-hydraulic proportional valve 15 is 100% turned on to prevent the upper structure from swinging rightwardly even if the operator of the excavator operates the right swing operation lever or operates the traveling lever rightward in order to travel the excavator rightward. In the case that the worker is working in AREA 4 or AREA 5 and the operator swings the upper structure rightwardly as described above, the right swing electro-hydraulic proportional valve 15 is 50% turned on to swing the upper structure slowly, whereby, this output value of 50% is regulatable by the external regulation terminal 20. With respect to the traveling control, in the case that any worker is working at the front of the lower structure within a range of 180°, the outputs of the right forward traveling and left forward traveling electro-hydraulic proportional valves 16 and 18 are 100% turned on to stop the forward traveling movement of the lower structure.

In the warning lamp 11, an individual indicating portion 1-6 is arranged for each of six AREAs and is adapted to be turned on to indicate an area where the worker is working. If two or more workers are working in different AREAs, the indicating portions respectively corresponding to the areas are turned on. A circle in the central portion of the warning lamp 11 is one of the AREAs. An arrow in the central portion designates a direction to which the lower structure of the excavator advances. Moreover, the portion of the excavator in which a sprocket is provided is regarded as the back portion of the excavator.

The external regulation terminal 20 is connected to the control unit 10 by serial connection and is used for change of the sense range of the sensor, a change of pattern of alarm sound, a change of the output value of the electro-hydraulic proportional valves, and for failure diagnosis.

While the present invention has been described with reference to a specific embodiment, the description is illustrative of the invention and is not to be construed as limiting the invention. Various modifications and applications may occur to those skilled in the art without departing from the true spirit and scope of the invention as defined by the appended claims.

We claim:

1. An alarm system for a constructional machine including an upper structure which is swingably supported by a lower structure, the alarm system comprising:

a worker position sensor for sensing the positions of workers who are working within the working range of the machine, said working range comprising a plurality of predetermined identifying areas;

distance determining means responsive to said worker position sensor for determining the relative distance between each of said workers and said machine;

workers sensing area determining means responsive to said distance determining means for identifying the positions of said workers in said plurality of predetermined identifying areas;

a machine sensor means for sensing the swing angle of said upper structure, the traveling direction of said lower structure, and the swing direction of said upper structure;

machine operation determining means responsive to said machine sensor means for determining said swing angle, said traveling direction, and said swing direction of said machine;

machine operation selecting mans responsive to said machine operation determining means for selecting one of three operational modes for said machine (stop, go, slow); and a drive unit responsive to said machine operation selecting means for driving said machine.

2. The alarm system according to claim 1, wherein the worker position sensor includes a plurality of radio frequency transceivers provided int he machine and a radio frequency transceiver carried by each worker.

3. The alarm system according to claim 1, wherein the worker position sensor includes three transceivers, each of which has a sensing angle of 180 angles to provide substantially six identifying areas from a combination of areas overlappingly covered by the transceivers.

4. The alarm system according to claim 1, wherein the machine sensor means includes a swing angle sensor, a traveling lever sensor, and a swing operation lever sensor.

5. The alarm system according to claim 1, wherein the distance determining means and the worker sensing area determining means are incorporated into a signal processing unit which is adapted to determine whether the relative distance between the machine and the workers is either of a short distance, a medium distance, or a long distance, and to identify the position of the workers in the plurality of predetermined identifying areas.

6. The alarm system according to claim 1, wherein the machine operation determining means and the machine operation selecting means are incorporated into a control unit.

7. The alarm system according to claim 1, wherein the drive unit includes a solenoid valve for driving a working operation control valve and a plurality of electro-hydraulic proportional valves for driving a swing control valve and a traveling control valve.

8. The alarm system according to claim 7 wherein the machine operation determining means and the machine operation selecting means are incorporated into a control unit.

9. The alarm system according to claim 8, further comprising an external regulation terminal connected to the control unit for changing the size of the predetermined identifying areas and changing an output value of the plurality of electro-hydraulic proportional valves.

* * * * *